US006551170B1

(12) United States Patent
Wang

(10) Patent No.: US 6,551,170 B1
(45) Date of Patent: Apr. 22, 2003

(54) SPRING LOOP NOVELTY DEVICE

(76) Inventor: Grace Wang, 2090 Del Rio Pl., Ontario, CA (US) 91761

( * ) Notice: Subject to any disclaimer, the term of this patent is extended or adjusted under 35 U.S.C. 154(b) by 0 days.

(21) Appl. No.: 10/117,800

(22) Filed: Apr. 9, 2002

(51) Int. Cl.[7] ..... A63H 33/00

(52) U.S. Cl. ..... 446/490; 446/76; 446/486; 446/487

(58) Field of Search ..... 446/490, 486, 446/487, 488, 148, 310, 311, 75; 206/315.1, 363, 449, 525

(56) References Cited

U.S. PATENT DOCUMENTS 275,282 A * 4/1883 Stanton et al.
978,489 A * 12/1910 Salmond
1,062,129 A * 5/1913 Sweeney
1,903,082 A * 3/1933 Adams
2,349,984 A * 5/1944 Ostrander
3,018,937 A * 1/1962 Frampton
D259,572 S * 6/1981 Renaud
4,709,928 A * 12/1987 Willingham ..... 273/309
4,774,780 A * 10/1988 Crowell ..... 40/124.1
4,787,160 A * 11/1988 Balsamo ..... 40/124.1
4,832,652 A * 5/1989 Matsuyama ..... 446/397
5,055,084 A * 10/1991 Jokic ..... 446/486
5,096,751 A * 3/1992 Duchek ..... 428/12
5,120,263 A * 6/1992 Ierfino et al. ..... 446/486
5,263,890 A * 11/1993 Dent, IV ..... 446/475
5,358,440 A * 10/1994 Zheng ..... 446/48
5,901,926 A * 5/1999 Zheng ..... 244/153 R
6,001,019 A * 12/1999 Al-Bannai ..... 472/54
6,199,912 B1 * 3/2001 Finkelshteyn ..... 283/117

* cited by examiner

*Primary Examiner*—Derris H. Banks
*Assistant Examiner*—Ali Abdelwahed
(74) *Attorney, Agent, or Firm*—Boniard I. Brown

(57) ABSTRACT

A novelty device has a compacted spring loop in a container. During an effort of a person to remove the loop from the container, the loop under stored spring energy expands toward its extended configuration to assist in opening the container or to fly out from the container to the surprise of the person.

20 Claims, 3 Drawing Sheets

SPRING LOOP NOVELTY DEVICE

BACKGROUND AND SUMMARY OF THE INVENTION

Collapsible spring loops have long been known, particularly as "FRISBEES" or throw loop amusement devices which are flung into the air to fly for some distance, in sometimes predetermined paths.

The present invention utilizes the spring loop device, familiar in other uses, in a surprise novelty device wherein a compacted loop having stored spring energy, during an unknowing person's effort to open a closure of the container, expands to its enlarged open configuration, forcing open the container closure and flying outward therefrom to the surprise of the person.

The spring loop novelty device has a closed loop with a spring characteristic compacted from its expanded configuration by the twisting of opposite sides thereof into a layered array wherein two smaller loops are overlaid, thus storing spring energy in the compacted loop. The compacted loop is enclosed in a container adapted to receive it, and having a manually openable closure to retain the compacted loop. During the process of a person manually opening the closure, the compacted loop suddenly expands under the spring energy stored therein to urge the closure open and to fly out from the container to the surprise of the person opening the closure.

In a second embodiment, a pouch has an open top for ease of insertion of a compacted loop and for ease of removal of the loop from the pouch by the expansion of the spring loop under the action of energy stored therein. The spring loop may expand upon being partially removed from the pouch and suddenly spring from the pouch into its expanded configuration, if the person removing the spring loop from the pouch is not aware of this capability of the spring loop.

DESCRIPTION OF THE PREFERRED EMBODIMENTS

Figure 1:
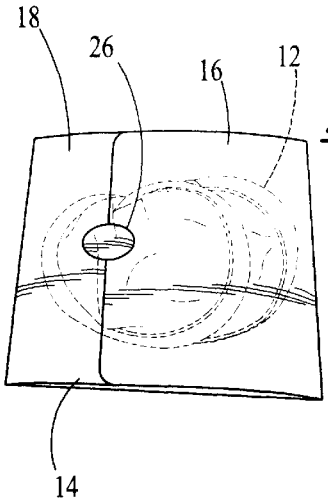
FIG. 1 is a perspective view of a container of the invention in closed configuration with a compacted spring loop shown therein in broken lines.

Referring to the drawings, FIGS. 1, 2A, 2B and 3 show a preferred embodiment 10 of the invention comprising a closed spring loop 12 and a container 14. The container comprises a bottom wall 16 opposite inwardly foldable flaps 18, 20 and transversely extending flaps 22, 24. An adhesive sticker closure 26 is applied across an end portion of one flap and onto another flap and serves as a closure (FIG. 1). Opening of the closure is effected by manually pulling the sticker for disengagement of one of the flaps or both flaps.

Figure 4:
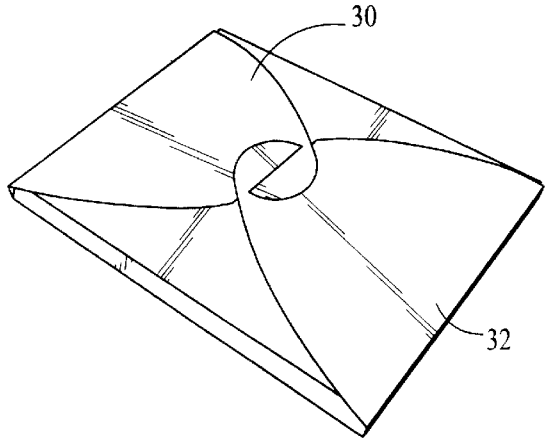
FIG. 4 is a perspective view of a second form of container according to the invention wherein overlapping flaps have interengaging slot portions to provide a closure.
Figure 5:
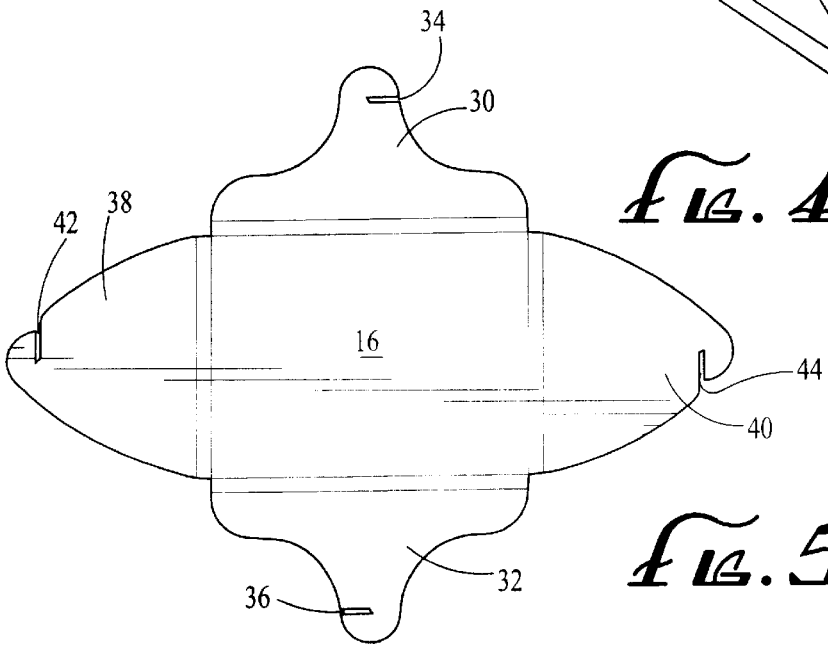
FIG. 5 is a plan view of a blank for the container of FIG. 4.

FIGS. 4 and 5 illustrate another form of the invention wherein transversely extending flaps 30, 32 each have a transverse edge slot 34, 36. A pair of oppositely disposed flaps 38, 40 extend transversely to flaps 30, 32 and have respective slots 42, 44. Engagement of the slots portions on folded opposite flaps provide closure of the container.

Figure 2A:
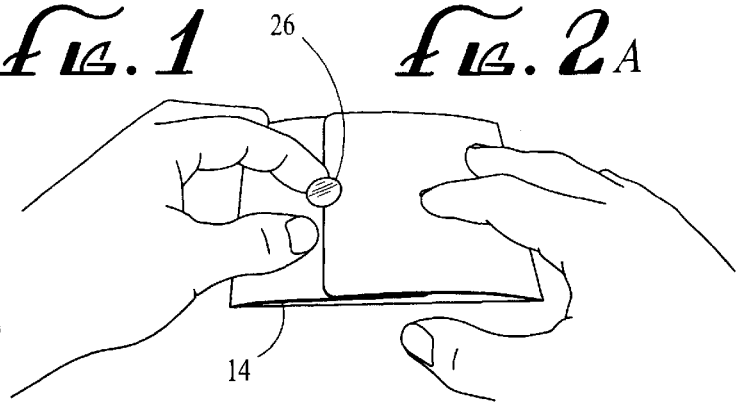
FIG. 2A is a perspective view of the container of FIG. 1 showing a person's hands opening the closure of the container.
Figure 2B:
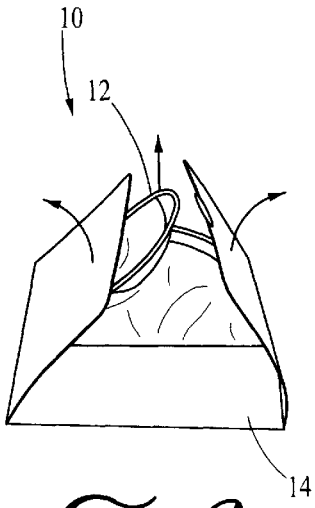
FIG. 2B is a perspective view showing the container of FIGS. 1 and 2A with the loop therein expanding to urge the container open.
Figure 2C:
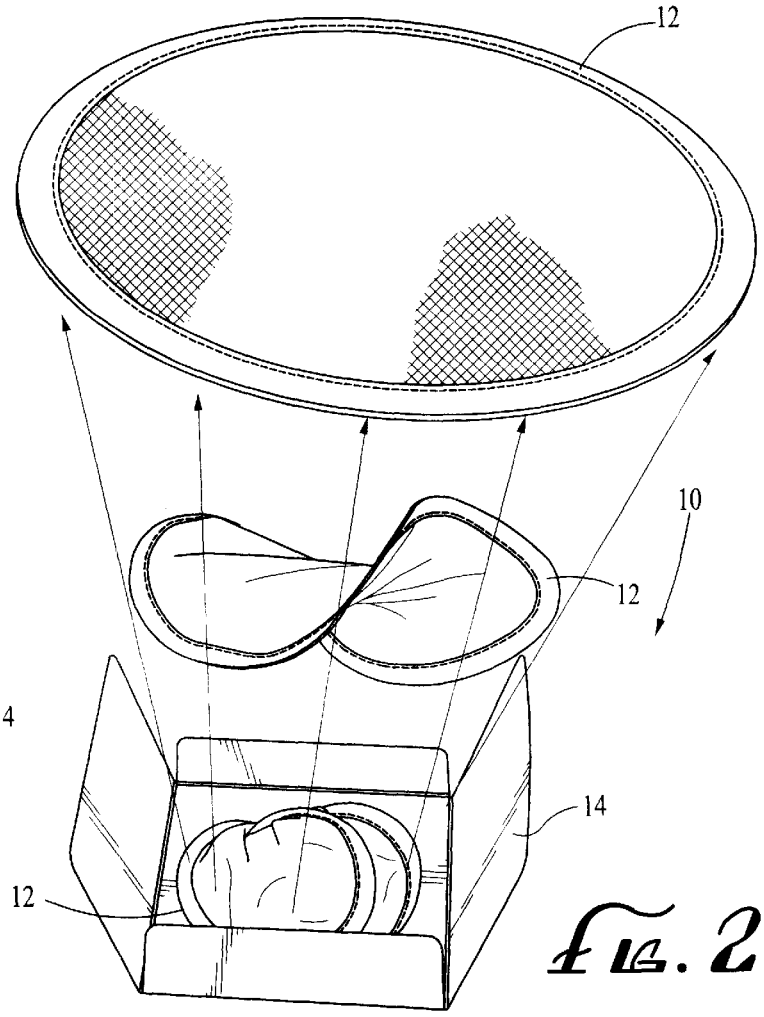
FIG. 2C is a perspective view showing the spring loop of FIG. 2B expanding to open the container and fly outwardly.
Figure 3:
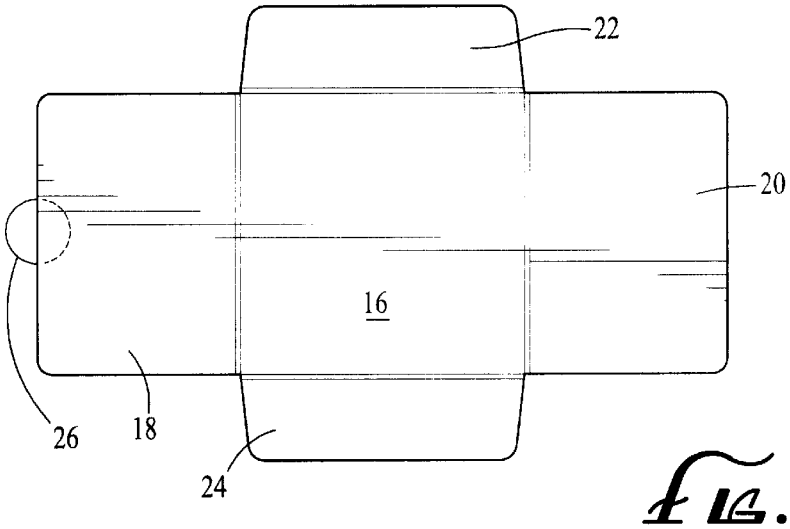
FIG. 3 is a plan view of a blank for the container of FIGS. 1, 2A and 2B.

The spring loop is disposed in the container in compacted configuration, and the container is adapted and sized to receive the compacted loop (FIG. 2C). The loop is compactable from its expanded loop configuration by twisting opposite sides of the loop to twist it into a layered array, two smaller loops being in overlaid relation. Spring energy is stored in the loop in the compacting process. Although a generally circular spring loop is shown in the drawings, it will be appreciated that the loop may have other configurations, such as oval, triangular, a heart-shape, etc., which forms are also twistable into a compactable configuration.

Either of the above mentioned closures is adapted to maintain the container closed against a certain amount of spring force exerted by the compacted loop. During the operation of manually opening the closure, the spring force overcomes the retention of the closure, opens the container, and the loop suddenly expands toward its expanded configuration (FIG. 2C) and flies out of the container. The person endeavoring to open the closure is suddenly surprised by the effect of the explosive action of the loop in exiting the container, as is the intended purpose of the device of the invention.

Figure 6:
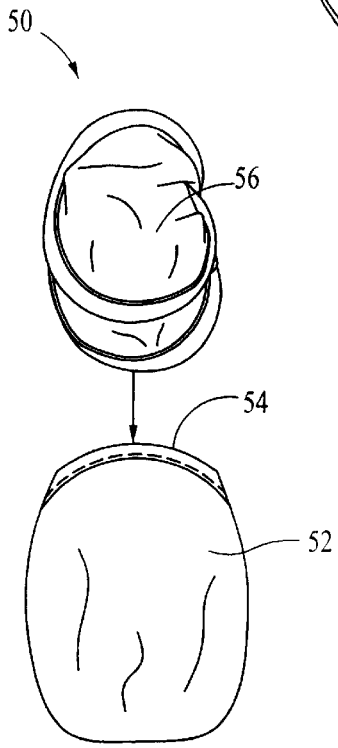
FIG. 6 is an elevational view of a compacted spring loop in association with an open pouch adapted to contain the compacted loop.
Figure 7:
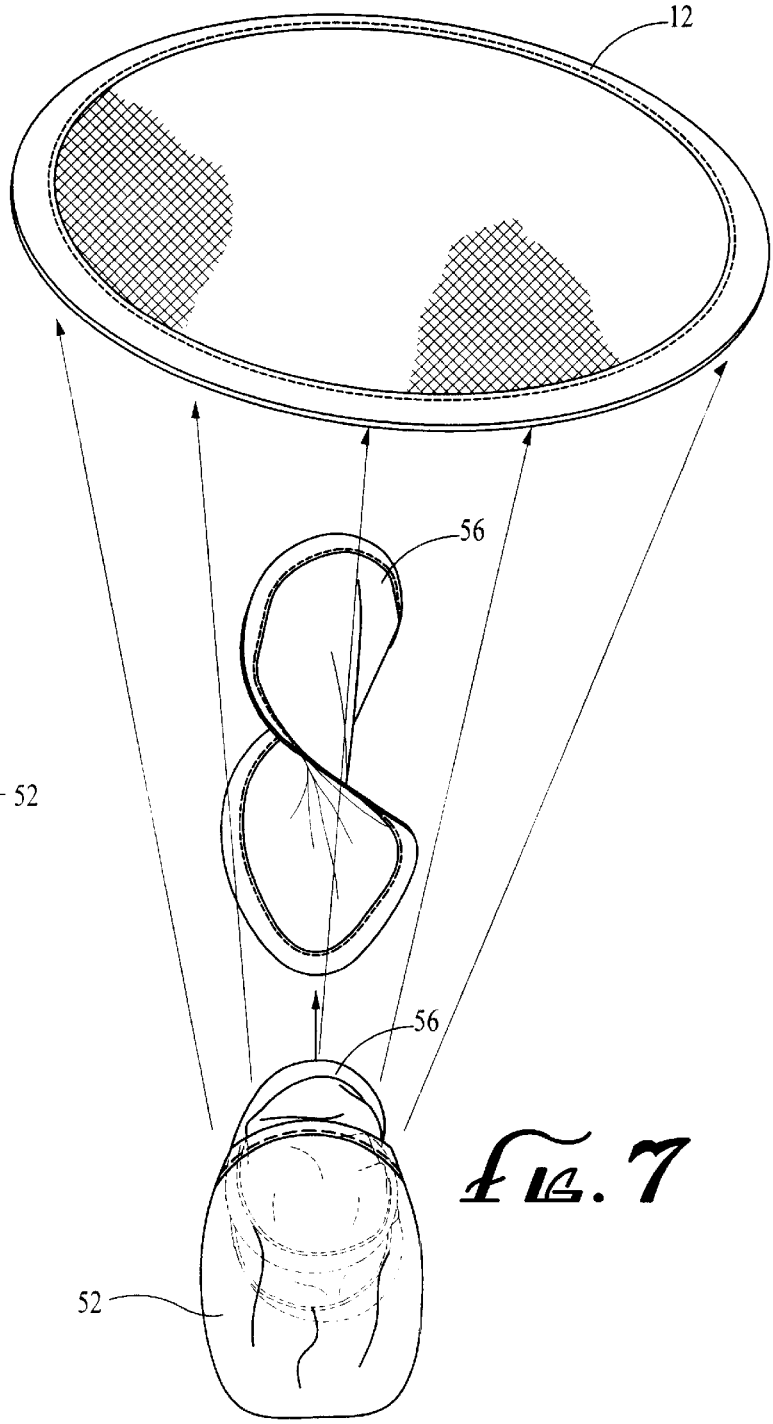
FIG. 7 shows the loop partially exiting the pouch, and shows it during and after expansion.

FIGS. 6 and 7 show another form of the invention 50 wherein a pouch 52 is utilized and has an opening 54 adapted to receive a compacted loop 56 for ease of transport and handling. As with the earlier-described embodiment, the loop is compacted by the twisting thereof into a compacted configuration with overlapping smaller loops.

Spring energy stored in the loop by being thus compacted causes the loop to expand during the manual removal thereof from the pouch. This expansion serves to facilitate the manual removal of the loop from the pouch normally, or it may provide a surprise for a person unfamiliar with the expansion capability of the compacted loops, and surprise such person by flying from the pouch and into its expanded configuration, as indicated in FIG. 7.

It will be understood that various changes and modifications may be made from the preferred embodiments discussed above without departing from the scope of the present invention, which is established by the following claims and equivalents thereof.

The inventor claims:

1. A spring loop novelty device, comprising:

a closed loop having a spring characteristic, said loop being compactable from its expanded configuration by twisting opposite sides of the loop to twist it into a layered array wherein two smaller loops are overlaid, whereby spring energy is stored in a compacted loop, a container adapted to receive the compacted loop, said container having manually operable closure means to retain the compacted loop in the container, and said closure means being so adapted and arranged that, during a process wherein a person manually opens the closure means, the compacted loop expands under action of the spring energy stored therein to urge the closure means open and to spring from the container while expanding, to surprise the person opening the closure means.

2. Apparatus according to claim 1, wherein partial opening of the closure means by the person releases the compacted loop to expand into its expanded configuration suddenly under the action of the spring energy stored therein.

3. Apparatus according to claim 1, wherein the compacted loop exerts spring force against the container closure means under the spring energy stored in the loop twisted into its compacted configuration.

4. Apparatus according to claim 1, wherein said closure means comprises an adhesive sticker attached across portions of the container, and wherein the container is opened by manual disengagement of the sticker from at least one of said portions.

5. Apparatus according to claim 1, wherein said closure means comprises inter-engaging slotted portions of two flaps and adapted to retain the flaps against the spring energy of the compacted loop.

6. Apparatus according to claim 1, wherein said loop is formed of (a) spring steel, (b) appropriate spring plastic, (c) metal wire.

7. Apparatus according to claim 1, and further comprising a web attached about and extending across said loop.

8. Apparatus according to claim 7, wherein said loop is enclosed in a peripheral hem of said web.

9. Apparatus according to claim 7, wherein said web is formed of (a) synthetic fabric, (b) plastic coated fabric, (c) plastic sheet, (d) stretch fabric.

10. A spring loop novelty device, comprising:

a closed loop having a spring characteristic, said loop being compactable from its expanded configuration by twisting opposite sides thereof to twist it into a layered array wherein two smaller loops are overlaid, whereby spring energy is stored in the loop, a container comprising a package sized and configurated to receive the loop and comprising a pair of overlapping closure flaps with inter-engaging slot portions engagable to provide closure means with portions of the flaps overlapping, and said overlapping closure flaps being so adapted and arranged that, during process of a person manually disengaging said flaps, the loop expands under spring energy stored therein to suddenly urge the closure means open and to fly from the container while expanding, thus to surprise the person.

11. Apparatus according to claim 10, wherein partial opening of the closure means by the person is sufficient to release the loop to expand suddenly under the energy stored therein and spring from the container.

12. Apparatus according to claim 10, wherein said loop is formed of (a) spring steel, (b) appropriate spring plastic, (c) metal wire.

13. Apparatus according to claim 10, and further comprising a web attached about and extending across said loop.

14. Apparatus according to claim 13, wherein said loop is enclosed in a peripheral hem of said web.

15. Apparatus according to claim 13, wherein said web is formed of (a) synthetic fabric, (b) plastic coated fabric, (c) plastic sheet, (d) stretch fabric.

16. A spring loop and carrying pouch therefor, comprising:

a closed loop having a spring characteristic, said loop being compactable from its expanded configuration by twisting opposite sides thereof to twist it into a layered array wherein two smaller loops are overlaid and spring energy is stored in the loop, the pouch adapted to receive the loop therein, said pouch having a top opening adapted to receive therethrough the loop for transport and handling, the spring energy stored in the loop by being compacted to cause the loop to expand during manual removal from the pouch to effect one of (a) facilitating removal of the loop from the pouch, (b) the loop suddenly springing outwardly from the pouch and enlarging to surprise a person opening the pouch.

17. Apparatus according to claim 16, wherein partial manual movement of the spring loop from the pouch enables the loop to expand toward its expanded configuration, thus facilitating removal and grasping of the loop.

18. Apparatus according to claim 16, wherein said loop is formed of (a) spring steel, (b) appropriate spring plastic, (c) metal wire.

19. Apparatus according to claim 16, and further comprising a web attached about and extending across said loop.

20. Apparatus according to claim 19, wherein said web is formed of (a) synthetic fabric, (b) plastic coated fabric, (c) plastic sheet, (d) stretch fabric.

* * * * *